US005294865A

United States Patent [19]

Haraden

[11] Patent Number: 5,294,865

[45] Date of Patent: Mar. 15, 1994

[54] LAMP WITH INTEGRATED ELECTRONIC MODULE

[75] Inventor: Thomas Haraden, Hamilton, Mass.

[73] Assignee: GTE Products Corporation, Danvers, Mass.

[21] Appl. No.: 947,192

[22] Filed: Sep. 18, 1992

[51] Int. Cl.[5] ..... H01J 7/44

[52] U.S. Cl. ..... 315/58; 315/71; 315/72; 439/611

[58] Field of Search ..... 313/315, 316, 318, 331; 315/51, 58, 69, 70, 71, 72, 73; 362/86; 439/232, 611, 613, 615, 733, 924

[56] References Cited

U.S. PATENT DOCUMENTS

| | | | |
|---|---|---|---|
| 692,260 | 2/1902 | Garwood | 315/68 |
| 882,258 | 3/1908 | Merritt | 439/615 |
| 982,470 | 1/1911 | Camp, Jr. | 315/69 |
| 3,148,305 | 9/1964 | Pearson | 315/51 |
| 3,215,972 | 11/1965 | Eriksson | 439/611 |
| 3,551,725 | 12/1970 | Brundige | 439/615 |
| 4,350,931 | 9/1982 | Niskin | 315/72 |
| 4,417,177 | 11/1983 | Damiano | 315/73 |
| 4,516,054 | 5/1985 | Shikama et al. | 315/71 |
| 4,695,768 | 12/1985 | Covington et al. | 315/73 |
| 5,030,890 | 7/1991 | Johnson | 315/208 |
| 5,126,634 | 6/1992 | Johnson | 315/71 |
| 5,214,354 | 5/1993 | Johnson | 315/71 |

*Primary Examiner*—Robert J. Pascal
*Assistant Examiner*—Arnold Kinkead
*Attorney, Agent, or Firm*—Joseph S. Romanow; Carlo S. Bessone

[57] ABSTRACT

A lamp assembly includes a sealed lamp envelope enclosing a filament, a screw shell connected to the lower portion of the envelope, and electrical leads extending from the filament into the screw shell. The screw shell has a bottom opening, in which is mounted an electronic control module. The electronic module is retained in the screw shell by an insulator. A spring is compressed between the electronic module and an exhaust tube on the lower portion of the envelope. One electrical lead is electrically coupled from the module through the spring to the filament, allowing the module to control the filament. The insulator defines a cavity for retention of the electronic module in a fixed position.

15 Claims, 3 Drawing Sheets

LAMP WITH INTEGRATED ELECTRONIC MODULE

FIELD OF THE INVENTION

This invention relates to electric lamps and, more particularly, to a lamp having an electronic module mounted in the lamp base for controlling lamp operation.

BACKGROUND OF THE INVENTION

A typical incandescent light bulb includes a sealed, light transmissive lamp envelope which encloses a filament. The filament has electrical leads which extend through a lamp stem to a base portion. The base is typically an aluminum or brass screw shell with a glass insulator and a center contact at the bottom.

An incandescent light bulb can be controlled by one of several types of electronic modules. These modules, each of which is designed for a specific purpose, have circuitry to control the light output of the lamp, causing the lamp to flash, to automatically dim over a period of time, to dim in steps, or to perform some other desired function. Suitable electronic modules are disclosed in U.S. Pat. No. 5,126,634, issued Jun. 30, 1992 to Johnson and U.S. Pat. No. 5,030,890, issued Jul. 9, 1991 to Johnson. U.S. Pat. No. 5,126,634 also discloses an incandescent lamp with integrated control circuitry.

It is desirable to provide an incandescent lamp assembly wherein an electronic module is mounted within the lamp base so that the lamp assembly can be installed in a conventional lamp socket. The lamp assembly must be low in cost, easy to manufacture and highly reliable.

It is a general object of the present invention to provide a lamp assembly with an integrated electronic module.

It is another object of the present invention to provide a lamp having an electronic module mounted in the base so that the lamp can be installed and operated in a conventional lamp socket.

It is a further object of the present invention to provide a lamp with an electronics module which is simple in construction and easy to use.

SUMMARY OF THE INVENTION

According to the present invention, these and other objects and advantages are achieved in a lamp assembly comprising a lamp envelope which encloses a filament, and a lamp base which is attached to the lamp envelope. Electrical leads extend from the filament through the lamp envelope into the lamp base. An electronic module is mounted in the lamp base and has circuitry for controlling operation of the filament. A conductive spring is compressed between an upper portion of the electronic module and a lower portion of the lamp envelope. One electrical lead is coupled to the spring for electrical connection to the electronic module.

The lower portion of the lamp envelope typically includes an exhaust tube having a larger diameter than the spring. The spring is compressed between the exhaust tube and the electronic module so that the one electrical lead is retained between the spring and the exhaust tube. The electronic module is at least partially enclosed by an insulator which comprises two halves. Each of the halves preferably includes a rib portion and a slot, and the rib portion of one half mates with the slot of the other half. The insulator retains the electronic module in a fixed position in the lamp assembly. The lamp base includes a screw shell having an opening in which the insulator is retained. The assembly can be installed in a conventional household lamp socket.

According to another aspect of the invention, a lamp assembly comprises a lamp envelope enclosing a filament and including electrical leads extending from the filament through the lamp envelope, a screw shell having a bottom opening, the screw shell being attached to a lower portion of the lamp envelope, an electronic module with circuitry for controlling the filament, the module being electrically coupled to one electrical lead and having a side wall, an upper wall and a lower wall, and an insulator which encloses the side wall and at least a portion of the upper and lower walls of the electronic module, the insulator being mounted within the opening of the screw shell.

The insulator preferably includes a peripheral groove, and the bottom opening in the screw shell is defined by a flange. The peripheral groove is dimensioned to engage the flange. The insulator defines a partially enclosed cavity for retention of the electronic module and for limiting axial and lateral movement of the electronic module in the lamp assembly.

BRIEF DESCRIPTION OF THE DRAWINGS

For a better understanding of the present invention together with other and further objects, advantages, and capabilities thereof, references is made to the accompanying drawings which are incorporated herein by reference and in which.

DETAILED DESCRIPTION OF THE INVENTION

Figure 1:
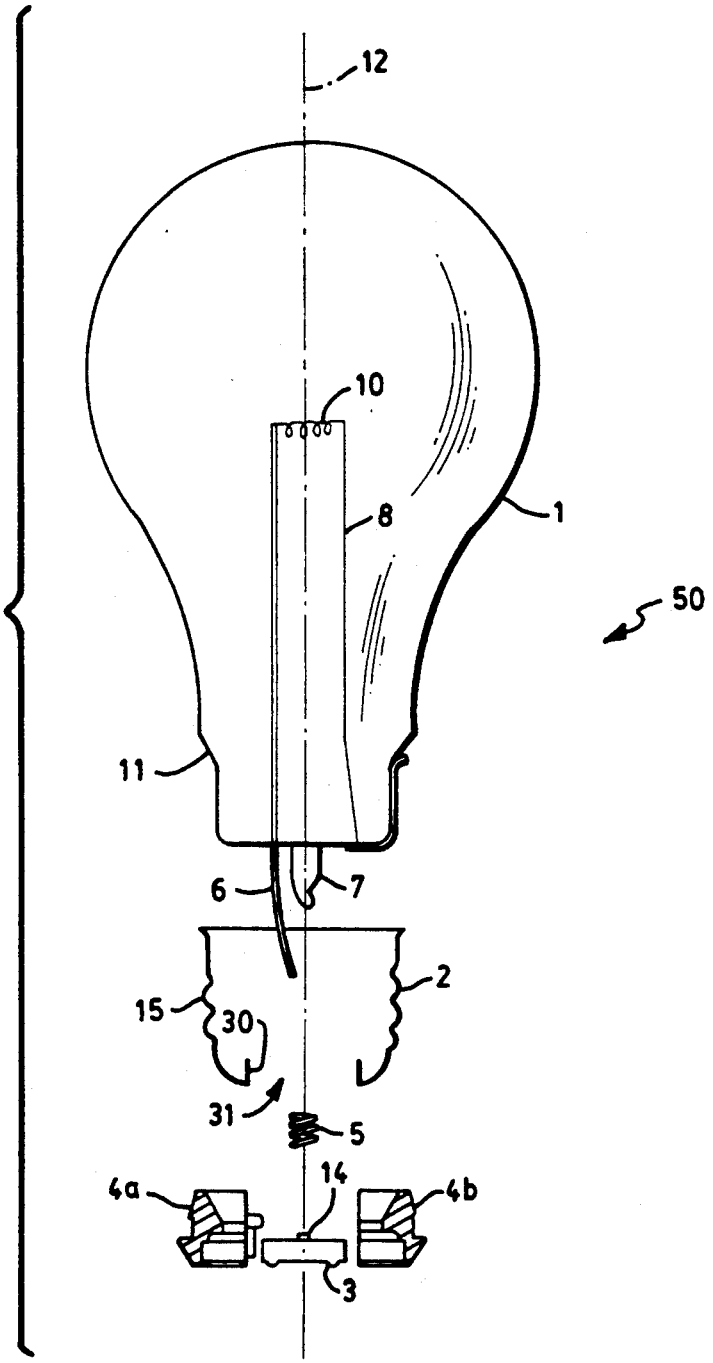
FIG. 1 is an exploded view of a lamp assembly in accordance with the present invention.

A lamp assembly 50 in accordance with the present invention is shown in FIG. 1. A filament 10 is mounted within a sealed, light transmissive lamp envelope 1. Electrical leads 6 and 8 are coupled to the filament and extend through a lamp stem (not shown). Lead 6 extends into the center portion of an aluminum screw shell 2. Lead 8 is bent around the neck portion of the lamp envelope and is connected to screw shell 2 in the completed lamp assembly. The screw shell has a side wall 15 which is threaded so that the assembly can be installed in a conventional light socket. At the lower portion of the screw shell is a generally circular opening 31 defined by a flange 30. An exhaust tube 7 extends from the lower portion of the envelope and is surrounded by the shell when the lower portion of the envelope is mounted to screw shell 2 as shown in FIG. 2.

Centered below envelope 1 and screw shell 2 is a circular, generally disc-shaped electronic module 3. The electronic module 3 can be constructed as disclosed in the aforementioned U.S. Pat. Nos. 5,126,634 and 5,030,890, which are hereby incorporated by reference. The module, which can control the light output of the lamp, is securely held on a side wall and partly on upper and lower walls by two insulator halves **4*a* and 4*b***. These insulator halves, which are preferably made from a polyetherimide such as ULTEM material produced by General Electric Co., hold the module when pressed together and prevent it from moving axially or laterally in the lamp assembly. Module 3 is aligned along axis 12 with a spring 5, the center of screw shell 2, the exhaust tube 7, and the center of envelope 1.

Figure 2:
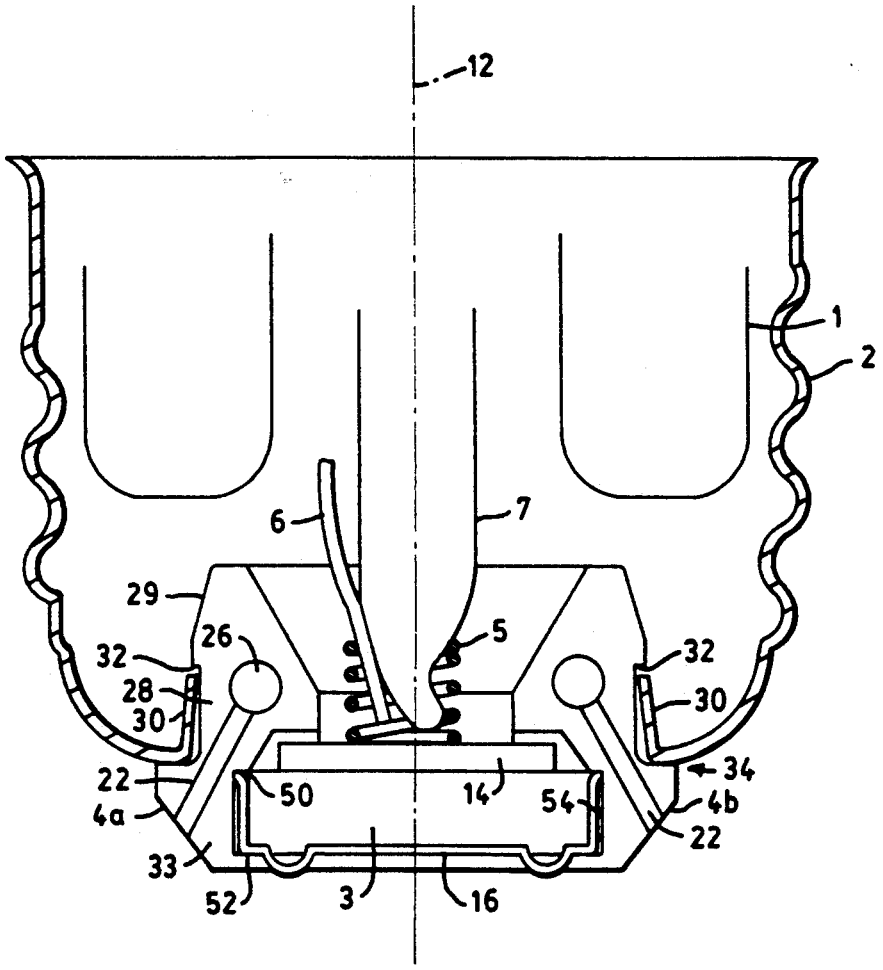
FIG. 2 is a cross sectional view of a portion of the lamp assembly of FIG. 1 in accordance with the present invention.

Referring to FIG. 2, spring 5 is compressed between a conductive strap 14 of module 3 and exhaust tube 7. The spring 5 has a smaller diameter than the exhaust tube in order to prevent it from being pushed over the tube. Spring 5 is preferably fabricated of stainless steel. Wire 6 is inserted between spring 5 and exhaust tube 7 and is secured in position by spring 5, thus completing an electrical connection from filament 10 (FIG. 1) through wire 6, spring 5 and conductive strap 14 to module 3.

During assembly, the lamp envelope 1 is positioned upside down. The lead 6 is placed on the exhaust tube 7, and the spring 5 positioned over the lead. The insulator and electronic module are then positioned to compress the spring and are snapped into the screw shell 2.

The screw shell, the insulator halves 4*a* and 4*b*, the electronic module 3 and the spring 5 constitute a lamp base. When the lamp base is installed in a conventional household lamp socket, the line voltage is applied between shell 16 of electronic module 3 and screw shell 2. Shell 16 in the lower portion of module 3 replaces the center eyelet of a typical lamp.

Figure 3:
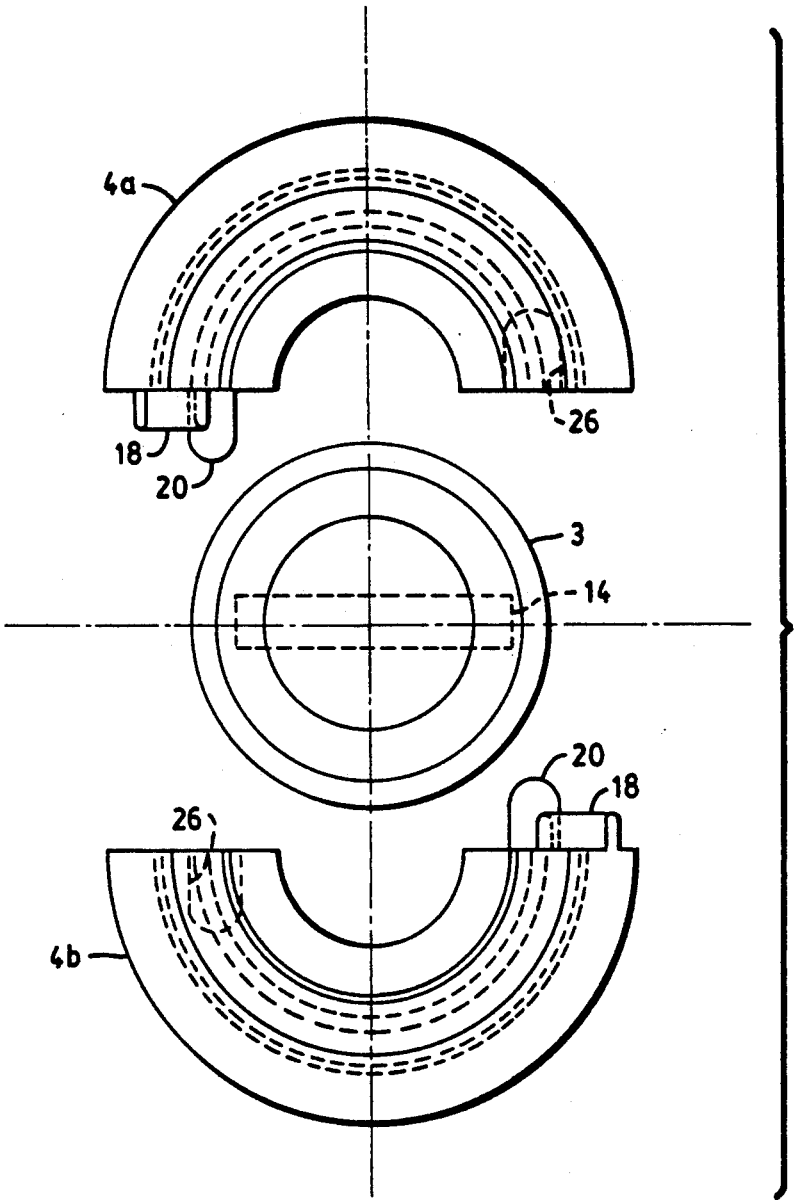
FIG. 3 is an exploded top view of the electronic module and insulator used in the lamp assembly.

Referring to FIG. 3, each of the insulator halves 4*a* and 4*b* is semi-annular in shape and has a rib 18 and a pin 20 on one side, and a hole 26 and a slot (not shown) on the other side. When the two halves are coupled together around the module, pin 20 fits within hole 26, and rib 18 fits within the corresponding slot. Referring again to FIG. 2, when the insulator halves 4*a* and 4*b* are put together, there is an air gap between them. At junction 22, the ribs (FIG. 3) and pins mate with corresponding slots and holes and partially block this gap, electrically isolating electronic module 3 from screw shell 2.

When the insulator halves 4*a* and 4*b* are coupled together to form an insulator, the insulator has an outside diameter in a center portion 28 which is slightly smaller than opening 31 (FIG. 1) in the lower portion of the screw shell 2. An upper portion 29 of the insulator is slightly larger in diameter than center portion 28 and forms a shoulder 32. As the coupled insulating halves and module are inserted into the opening 31 of the screw 2 shell, the upper portion 29, which is preferably tapered at about 15°, causes the opening 31 to expand. When shoulder 32 passes the flange 30, the opening contracts and the center portion of the insulator is aligned with flange 30. A bottom portion 33 of the insulator is larger in diameter than center portion 28, thus creating a lower shoulder 34 which prevents the insulator from being inserted too far into the screw shell 2 opening. Thus, bottom portion 33 prevents halves 4*a* and 4*b* from being inserted too far into the opening 31, and the upper portion 29 prevents the halves from being pushed out of the screw shell by the spring.

The shoulders 32 and 34 of the insulator define a peripheral groove for receiving flange 30 of inner shell 2. The disclosed structure permits the insulator halves 4*a* and 4*b* containing electronic module 3 to be snapped into the lamp base with the flange 30 engaging the peripheral groove in the insulator.

The insulator retains the electronic module 3 in a fixed position in the lamp base without requiring an adhesive. The insulator halves 4*a* and 4*b* define a partially enclosed cavity for retention of electronic module 3. The cavity is defined by an annular upper surface 50 and an annular lower surface 52 which limit axial movement of electronic module 3, and by a cylindrical outer surface 54 which limits lateral movement of electronic module 3. The spring 5 provides electrical contact between the electronic module 3 and filament 10 without solder or welding.

The lamp assembly of the present invention provides a very convenient and compact arrangement. The lamp assembly can be mounted in a conventional lamp socket without modification of the socket.

While there has been shown and described what is at present considered the preferred embodiment of the present invention, it will be obvious to those skilled in the art that various changes in and modifications may be made therein without departing from the scope of the invention as defined by the appended claims.

What is claimed is:

1. A lamp assembly comprising:
   - a lamp envelope enclosing a filament and including electrical leads extending from the filament through the lamp envelope;
   - a lamp base attached to the lamp envelope;
   - an electronic module mounted in the lamp base, said module including circuitry for controlling the filament; and
   - a conductive spring compressed between an upper portion of the electronic module and a lower portion of the lamp envelope, said lower portion of the lamp envelope includes an exhaust tube and wherein said spring engages said exhaust tube, one electrical lead being coupled to said spring for electrical connection to said electronic module.

2. A lamp assembly as defined in claim 1 wherein said one electrical lead being retained between said spring and said exhaust tube.

3. A lamp assembly as defined in claim 1 wherein the electronic module has side walls and said lamp base comprises an insulator for enclosing at least the side walls so that the electronic module is retained in a fixed position in said lamp assembly by said insulator.

4. A lamp assembly as defined in claim 3 wherein the insulator comprises two halves.

5. A lamp assembly as defined in claim 4 wherein each of said two halves includes a rib portion and a slot so that the rib portion of one half mates with the slot in the other half.

6. A lamp assembly as defined in 1 wherein said lamp base comprises a screw shell coupled to the lower portion of the lamp envelope for installation in a conventional household lamp socket.

7. A lamp assembly as defined in claim 3 wherein said lamp base further comprises a screw shell connected to the envelope, said screw shell having an opening, said insulator being retained within said opening.

8. A lamp assembly as defined in claim 2 wherein the spring has a smaller diameter than the exhaust tube.

9. A lamp assembly comprising:
   - a lamp envelope enclosing a filament and including electrical leads extending from the filament through the lamp envelope;
   - a screw shell having a bottom opening, said screw shell being attached to lower portion of the lamp envelope;
   - an electronic module with circuitry for controlling the filament, said module being electrically coupled to one electrical lead, and having a side wall, an upper wall, and a lower wall; and an insulator which encloses the side wall and at least a portion of the upper and lower walls of the electronic module, said insulator being mounted within the opening of said screw shell and comprises two halves.

10. A lamp assembly as defined in claim 9 wherein said insulator includes a peripheral groove and the bottom opening in said screw shell is defined by a flange, said peripheral groove being dimensioned to engage said flange.

11. A lamp assembly as defined in claim 9 further comprising a spring which is compressed between an electrical contact in the upper portion of the electronic module and a lower portion of the lamp envelope, said one electrical lead being retained by the compressed spring.

12. A lamp assembly as defined in claim 9 wherein each of said two halves includes a rib portion and a slot, the rib portion of one half mating with the slot in the other half.

13. A lamp assembly as defined in claim 9 further comprising a spring compressed between the module and the envelope, said spring being electrically coupled to the electrical lead.

14. A lamp assembly as defined in claim 10 wherein the insulator and the module form an assembly which can be inserted into the opening of the screw shell and retained without an adhesive.

15. A lamp assembly as defined in claim 9 wherein said insulator defines a partially enclosed cavity for retention of said electronic module and for limiting axial and lateral movement of said electronic module.

* * * * *